US005491981A

United States Patent [19]

Kim

[11] Patent Number: 5,491,981

[45] Date of Patent: Feb. 20, 1996

[54] REFRIGERATION CYCLE HAVING AN EVAPORATOR FOR EVAPORATING RESIDUAL LIQUID REFRIGERANT

[75] Inventor: Jong-Youb Kim, Suwon, Rep. of Korea

[73] Assignee: Samsung Electronics Co., Ltd., Suwon, Rep. of Korea

[21] Appl. No.: 304,850

[22] Filed: Sep. 13, 1994

[30] Foreign Application Priority Data

Sep. 15, 1993 [KR] Rep. of Korea ..... 93-18567

[51] Int. Cl.[6] ..... F25B 13/00

[52] U.S. Cl. ..... 62/324.6; 62/513

[58] Field of Search ..... 62/513, 324.6, 62/503

[56] References Cited

U.S. PATENT DOCUMENTS

| | | | |
|---|---|---|---|
| 3,246,482 | 4/1966 | Harnish | 62/513 X |
| 3,606,990 | 10/1971 | Bottum | 62/503 X |
| 3,766,748 | 10/1973 | Bottum et al. | 62/503 X |
| 3,872,687 | 3/1975 | Bottum et al. | 62/503 X |
| 4,236,381 | 12/1980 | Imral et al. | 62/513 X |
| 4,942,743 | 7/1990 | Gregory | 62/513 X |
| 5,174,123 | 12/1992 | Erickson | 62/513 X |

*Primary Examiner*—William E. Tapolcai
*Attorney, Agent, or Firm*—Burns, Doane, Swecker & Mathis

[57] ABSTRACT

An air conditioner system includes internal and external heat exchangers and a compressor for refrigerant. During cooling and heating operations, one of the heat exchangers discharges a first flow of gaseous refrigerant which is to be conducted to the compressor inlet. In order to evaporate any residual liquid refrigerant in the first flow, the first flow is passed through an evaporator in heat exchange relationship with a second flow of refrigerant discharged from the other heat exchanger. The evaporator is connected by valved conduits to receive the second flow from either the indoor or outdoor heat exchanger, depending upon whether the system is in a heating mode or a cooling mode. Within the evaporator, an upper chamber which receives the first flow is recessed into a lower chamber which receives the second flow and contains a heat transfer structure for promoting an efficient heat exchange.

16 Claims, 6 Drawing Sheets

COOLING OPERATION ——→
HEATING OPERATION - - - - →

FIG. 6
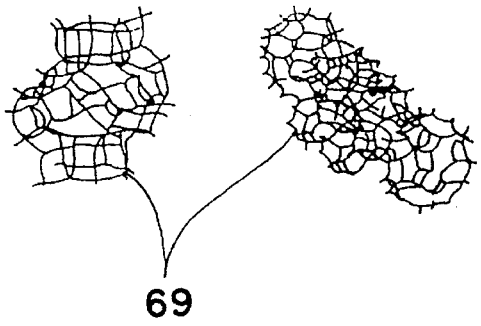
FIG. 7a
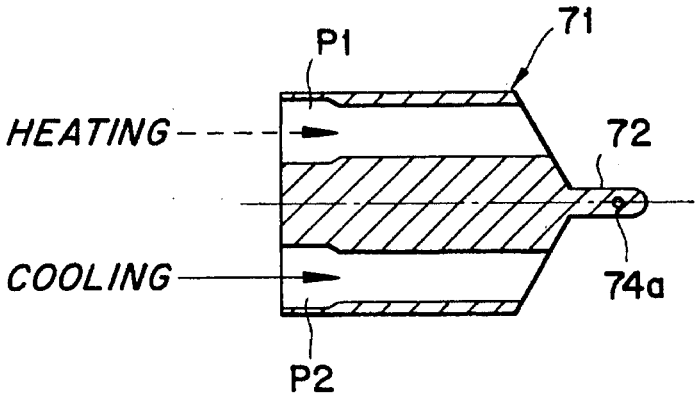
FIG. 7b
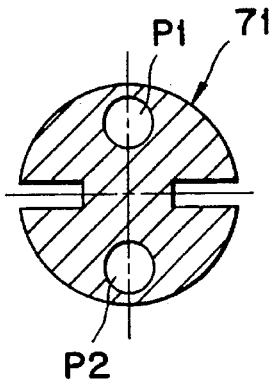
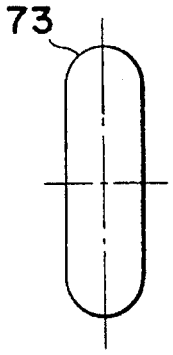
FIG. 8a
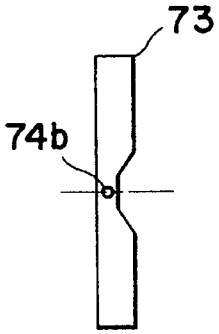
FIG. 8b

REFRIGERATION CYCLE HAVING AN EVAPORATOR FOR EVAPORATING RESIDUAL LIQUID REFRIGERANT

BACKGROUND OF THE INVENTION

1. Field of the Invention

The present invention relates in general to a heating for facilitating the evaporation of remaining liquid phase refrigerant.

2. Description of the Prior Art

A typical combined liquid receiver and liquid divider (hereinbelow, referred to simply as "the combined liquid receiver and divider") having heat exchanging means therein is disclosed in Japanese Patent Laid-open Publication No. Sho. 50-141744 entitled "a combined liquid receiver and liquid divider having heat exchanging means therein".

As shown in FIG. 1 showing in a schematic diagram a heating and cooling air conditioner with the above-mentioned combined liquid receiver and liquid divider, the high temperature and high pressure gas refrigerant, after being compressed by a refrigeration compressor unit 1, is cooled and condensed in a condenser 2. The high temperature and high pressure gas refrigerant is thus reduced from its vapor phase to its liquid phase.

The liquid refrigerant, after being condensed in the condenser 2, in turn is introduced into a liquid receiver part 5*a* provided in the upper section of the combined liquid receiver and liquid divider 5.

The liquid refrigerant in turn is discharged through an outlet 4*a* provided in the divider wall 5*c* of the liquid receiver part and, thereafter, introduced into a pressure reducing unit 4 via conduit 4*b* having a heat exchanging coil 4*c*. In the pressure reducing unit 4, the refrigerant becomes low temperature and low pressure liquid refrigerant.

At this time, the heat generated in the liquid receiver part of the combined liquid receiver and divider 5 is transferred to a liquid divider part provided 5*b* in the lower section of the combined liquid receiver and divider 5.

The low temperature and low pressure liquid refrigerant of the pressure reducing unit 4 is, thereafter, introduced into an evaporator 3 where the low temperature and low pressure refrigerant exchanges heat with outside air and evaporates.

The gas refrigerant which was evaporated in the evaporator 3 is introduced into the liquid divider part of the combined liquid receiver and divider 5 via conduit 3*a* and, thereafter, introduced into the refrigeration compressor unit 1 through a conduit extending from the divider wall 5*c* to the compressor unit 1. The above procedure is repeated in a cooling operation of the heating and cooling air conditioner.

At this time, there remains refrigerant of the liquid phase after evaporation of the refrigerant in the evaporator 3 and the remaining liquid phase refrigerant is introduced into the liquid divider part 5*b* of the combined liquid receiver and divider 5.

However, the heat transfer caused by the internal heat exchange between the liquid receiver part and the liquid divider part of the above combined liquid receiver and divider 5 is carried out only at the wall 5*c* between the liquid receiver part and the liquid divider part. In this regard, the combined liquid receiver and divider 5 can not completely evaporate the remaining liquid phase refrigerant residing in the liquid divider part 5*b*, thus failing in the prevention of stratified division between compressor oil and the remaining liquid phase refrigerant. This causes a deterioration of operational reliability of the compressor of the heating and cooling air conditioner.

SUMMARY OF THE INVENTION

It is, therefore, an object of the present invention to provide a heating and cooling air conditioner in which the above problem can be overcome and which is provided with a heat absorption fins, a net, and refrigerant flow direction regulating means in the combined liquid receiver and divider, thus to improve operational efficiency of the air conditioner, which air conditioner also achieves smooth oil recovery of the compressor and, as a result, improves operational reliability of the compressor.

In order to accomplish the above object, a heating and cooling air conditioner in accordance with an embodiment of the present invention comprises a combined liquid receiver and liquid divider having heat exchanging means therein, further comprises: refrigerant flow direction regulating means for opening one of a heating refrigerant conduit and a cooling refrigerant conduit simultaneously with closing the other conduit so as to regulate flow of refrigerant for a liquid receiver part of the combined liquid receiver and liquid divider in accordance with operation of the air conditioner, both conduits being connected to an inlet of the combined liquid receiver and liquid divider; and a refrigerant outlet conduit for discharging refrigerant from the liquid receiver part of the combined liquid receiver and liquid divider to an associated pressure reducing unit, the refrigerant having been introduced into the liquid receiver part under the regulation of the refrigerant flow direction regulating means in accordance with operation of the air conditioner.

BRIEF DESCRIPTION OF THE DRAWINGS

Other objects and aspects of this invention will become apparent from the following description of embodiments with reference to the accompanying drawings, in which:

FIG. 6 is a view showing a structure of the net of FIG. 4;

FIGS. 7*a* and 7*b* are a longitudinal sectional view and a cross sectional view of a base of a refrigerant flow direction regulating unit installed in the combined liquid receiver and divider of FIG. 3 respectively;

FIGS. 8*a* and 8*b* are a front view and a side view of a valve of the refrigerant flow direction regulating unit of the combined liquid receiver and divider of FIG. 3 respectively.

DESCRIPTION OF THE PREFERRED EMBODIMENTS

Figure 1:
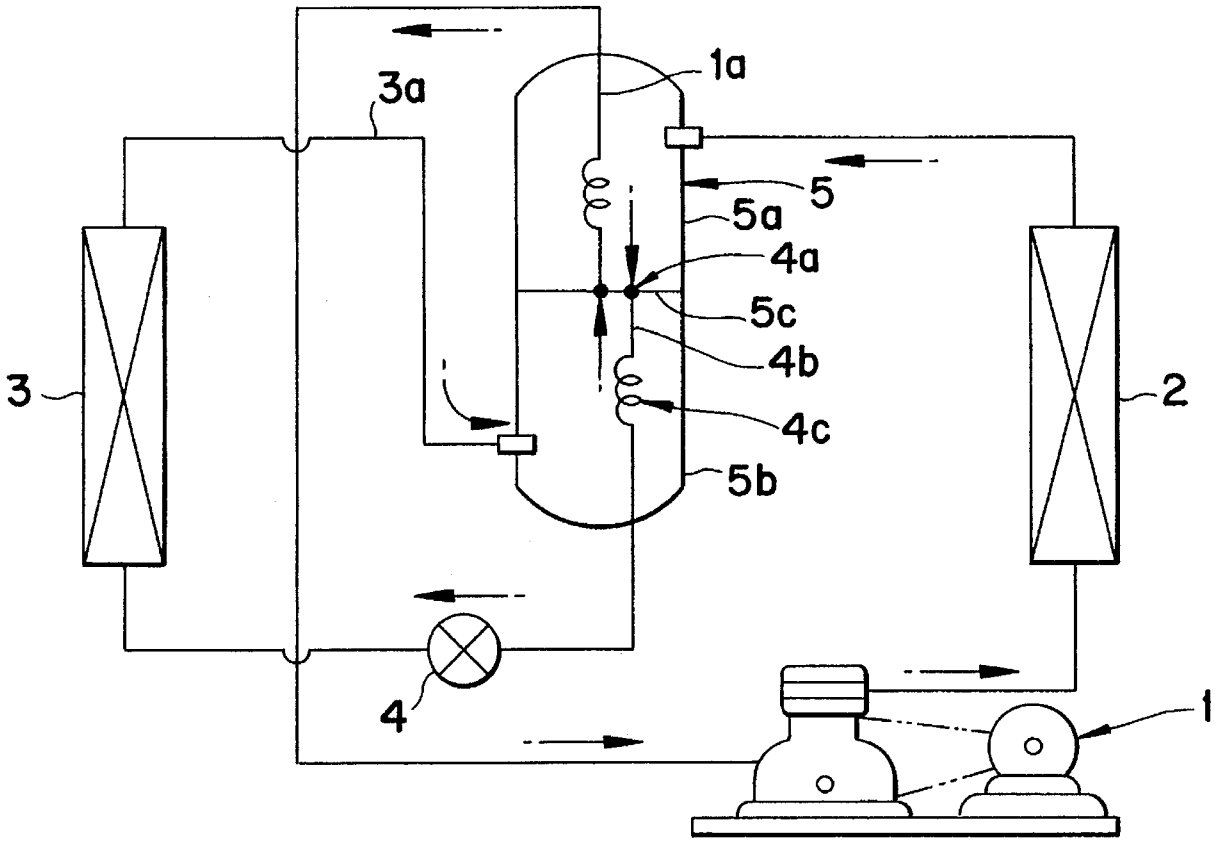
FIG. 1 (PRIOR ART)
FIG. 1 is a diagrammatic view showing a construction of a heating and cooling air conditioner having a typical combined liquid receiver and divider having heat exchanging means therein.
Figure 2:
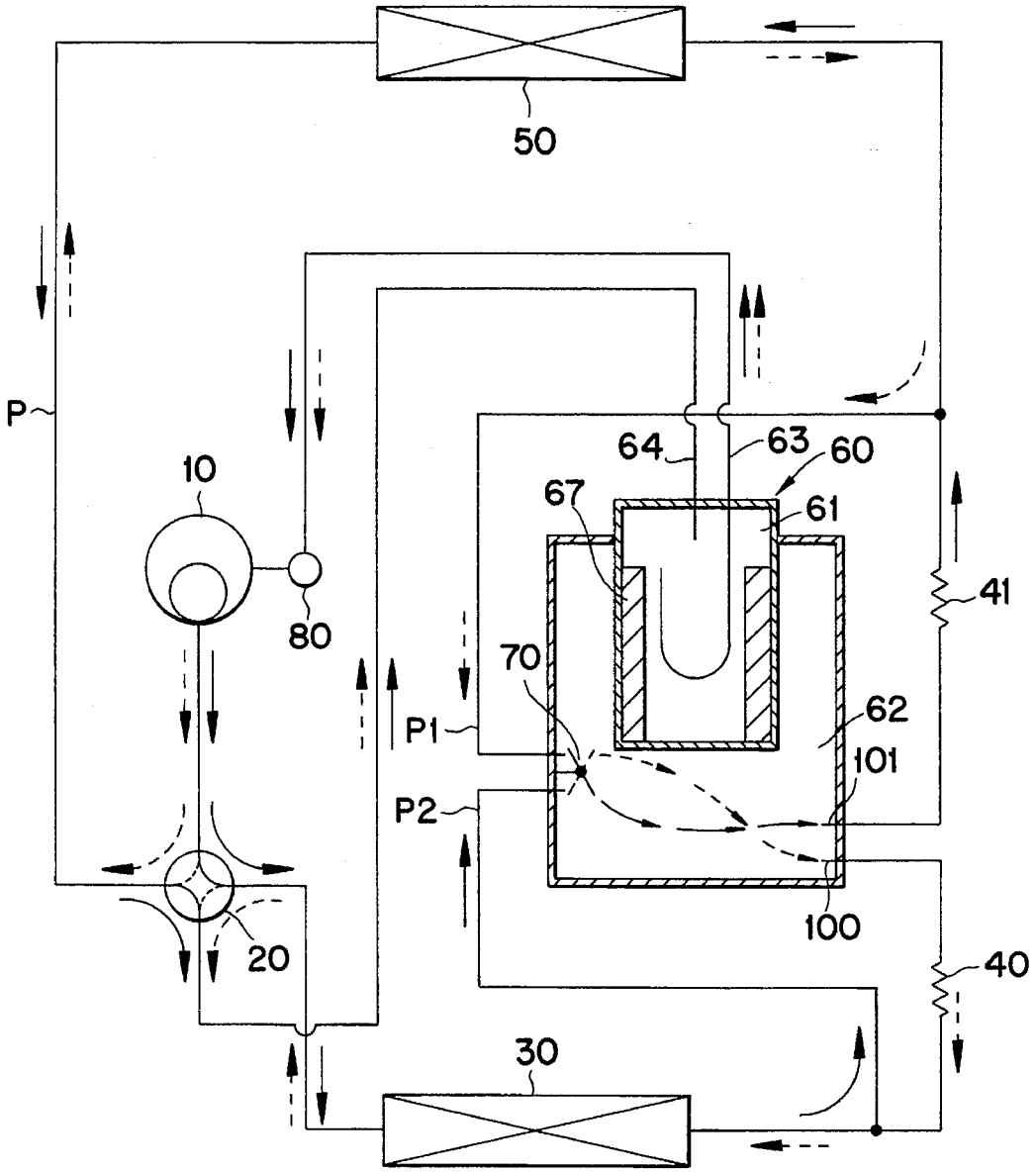
FIG. 2 is a diagrammatic view showing a construction of a heating and cooling air conditioner having a combined liquid receiver and divider in accordance with a primary embodiment of the present invention.

Referring first to FIG. 2, there is shown in a diagrammatic view a construction of a heating and cooling air conditioner having a combined liquid receiver and divider in accordance with a primary embodiment of the present invention. In the air conditioner, a compressor 10, a four-way valve or a refrigerant flow direction selecting valve 20, an external heat exchanger 30, a pair of pressure reducing units, that is, a first pressure reducing unit 40 and a second pressure reducing unit 41, an internal heat exchanger 50 and the combined liquid receiver and divider 60 having heat exchanging means therein are connected to each other through conduits P.

As shown in FIG. 2, the heating and cooling air conditioner carries out either the heating operation or the cooling operation in accordance with refrigerant flow direction selecting operation of the direction selecting valve 20.

The external heat exchanger 30, which is connected to the direction selecting valve 20 at one end thereof, is connected at the other end thereof to an inlet of a liquid receiver part 62 of the combined liquid receiver and divider 60 through the conduit P2. With the connection of the exchanger 30 to the inlet of the liquid receiver part 62, the refrigerant is introduced into a cooling-side pressure reducing unit or the second pressure reducing unit 41 during a cooling operation of the air conditioner. The other end of the external heat exchanger 30 is also connected to a first outlet 100 of the liquid receiver part 62 by way of a heating-side pressure reducing unit or the first pressure reducing unit 40. With the connection of the exchanger 30 to the first outlet 100 of the liquid receiver part 62, the refrigerant of the internal heat exchanger 50 is introduced into the external heat exchanger 30 during a heating operation of the air conditioner.

Meanwhile, the internal heat exchanger 50, which is connected to the direction selecting valve 20 at one end thereof, is connected at the other end thereof to the inlet of the liquid receiver part 62 of the combined liquid receiver and divider 60 through the heating-side conduit P1. With the connection of the exchanger 50 to the inlet of the liquid receiver part 62, the refrigerant is introduced into the heating pressure reducing unit 40 during the heating operation of the air conditioner. The other end of the internal heat exchanger 30 is also connected to a second outlet 101 of the liquid receiver part 62 by way of the cooling pressure reducing unit 41. With the connection of the exchanger 50 to the second outlet 101 of the liquid receiver part 62, the refrigerant of the external heat exchanger 30 is introduced into the internal heat exchanger 50 during the cooling operation of the air conditioner.

The inlet of the liquid receiver part 62 coupled to the heating-side conduit P1 should be regulated in order to cause the refrigerant to flow to the heating pressure reducing unit 40 during the heating operation. The inlet of the liquid receiver part 62 coupled to the cooling-side conduit P2 should be regulated in order to cause the refrigerant to flow to the cooling pressure reducing unit 41 during the cooling operation. In order to achieve the above object, the combined liquid receiver and divider 60 is provided with refrigerant flow direction regulating means. In the primary embodiment, the refrigerant flow direction regulating means comprises a direction regulating unit 70 placed about the inlets inside the liquid receiver part 62. The unit 70 regulates the inlet of the liquid receiver part 62.

As shown in FIG. 2, the direction regulating unit 70 and the pair of refrigerant outlets 100 and 101 are provided on opposed side walls of the liquid receiver part 62.

During the cooling operation of the air conditioner, the direction selecting valve 20 selects the refrigerant flow direction such that the high temperature and high pressure refrigerant, after being compressed by the compressor 10, is introduced into the external heat exchanger 30. In this case, the valve 20 also selects the refrigerant flow direction such that the gas refrigerant, after evaporating in the internal heat exchanger 50, is introduced into a liquid divider part 61 of the combined liquid receiver and divider 60 through a refrigerant inlet conduit 64.

During the heating operation of the air conditioner, the direction selecting valve 20 selects the refrigerant flow direction such that the high temperature and high pressure refrigerant, after being compressed by the compressor 10, is introduced into the internal heat exchanger 50. In this case, the valve 20 also selects the refrigerant flow direction such that the gas refrigerant, after evaporating in the external heat exchanger 30, is introduced into the liquid divider part 61 of the combined liquid receiver and divider 60 through the inlet conduit 64.

The refrigerant flow direction selecting valve 20, which is connected to the external heat exchanger 30, is also connected to the inlet conduit 64 extending to the liquid divider part 61. The valve 20 is further connected to an outlet conduit 63 by way of both the compressor 10 and a main liquid receiver 80. The conduit 63 extends from the liquid divider part 61.

Figure 3:
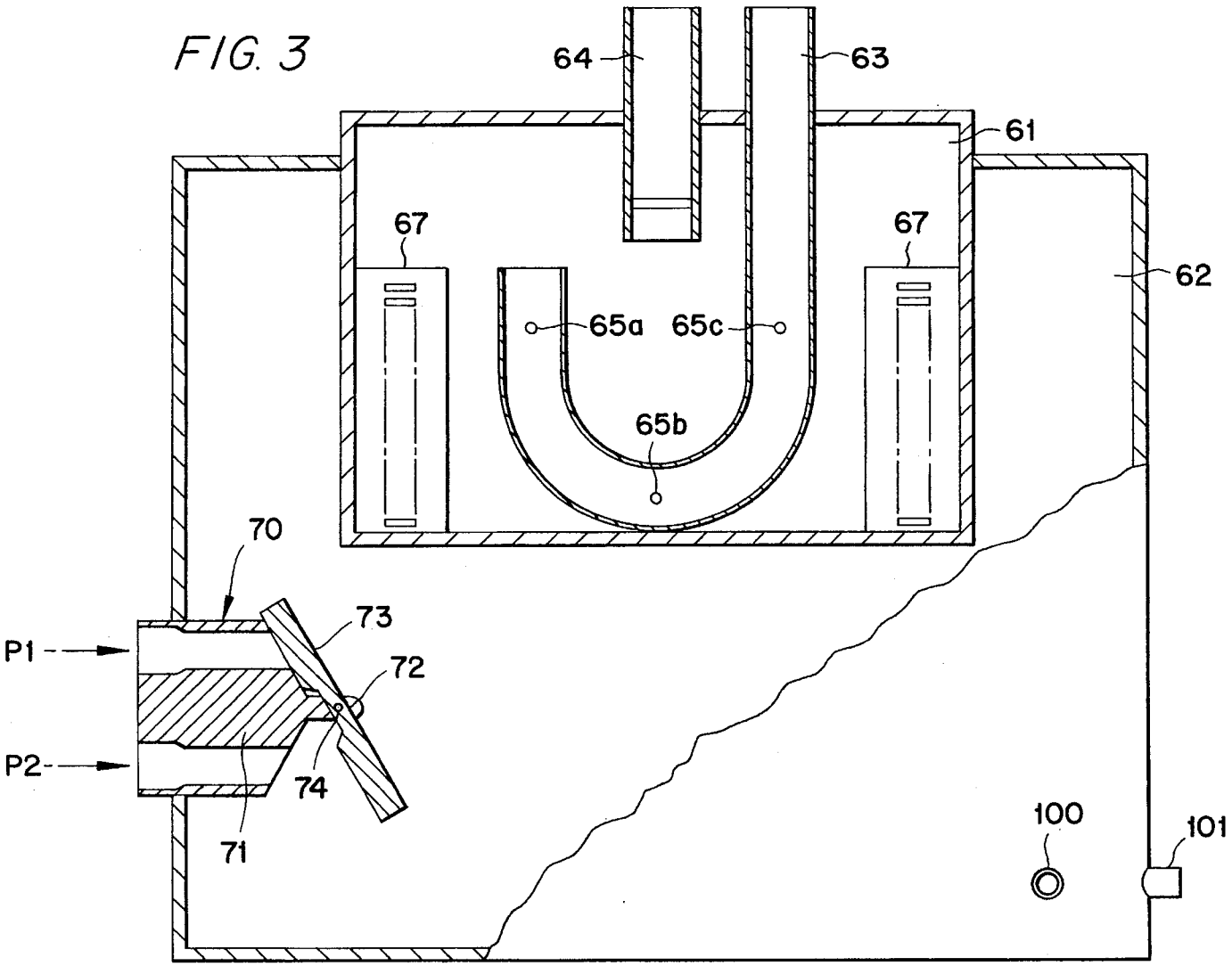
FIG. 3 is a partially sectioned view of the combined liquid receiver and divider of FIG. 2.

Turning to FIG. 3, there is shown in a partially sectioned view the combined liquid receiver and divider 60 of FIG. 2. As shown in this drawing, the liquid divider part 61 is placed in the upper section of the liquid receiver part 62 of the combined liquid receiver and divider 60. Extending to and from the top of the liquid divider part 61 are the refrigerant inlet conduit 64 and the refrigerant outlet conduit 63 respectively. Here, the refrigerant inlet conduit 64 is adapted for flow of the refrigerant from the valve 20 to the liquid divider part 61 while the refrigerant outlet conduit 63 is adapted for flow of the refrigerant from the liquid divider part 61 to the compressor 10 through the main liquid receiver 80.

In order to facilitate oil recovery of the compressor 10, the refrigerant outlet conduit 63 in the interior of the liquid divider part 61 is provided with a plurality of oil return holes 65*a*, 65*b* and 65*c*.

In the interior of the liquid divider part 61, a heat absorption fin 67 is placed such that it comes into contact with the inner side surface of the liquid divider part 61.

Figure 4:
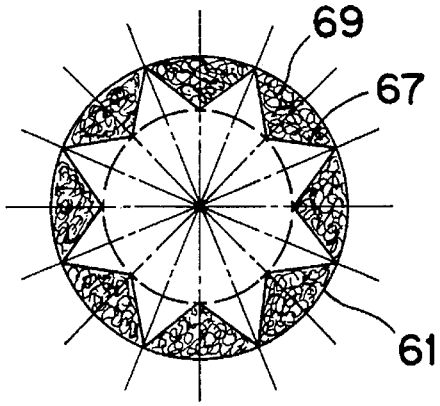
FIG. 4 is a cross sectioned view of a liquid divider part of the combined liquid receiver and divider of FIGS. 2 and 3, showing relative position between a heat absorption fin, a refrigerant evaporating net and the liquid divider part.

As shown in FIG. 4 showing the liquid divider part 61 in a cross sectional view, the heat absorption fin 67 is a hollow star-shaped body having a predetermined height. The sharpened edges of the hollow star-shaped fin 67 come into contact with the inner side surface of the liquid divider part 61 for defining a plurality of sectoral column spaces between the outer surface of the fin 67 and the inner side surface of the part 61. The sectoral column spaces defined between the heat absorption fin 67 and the inner side surface of the part 61 are filled with nets 69 respectively.

Figure 5:
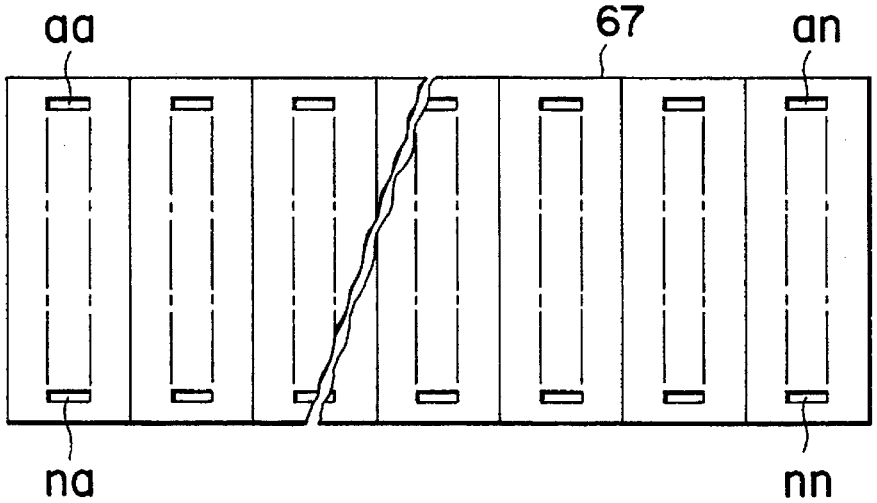
FIG. 5 is a development view of the heat absorption fin of FIGS. 2 to 4.

Turning to FIG. 5 showing the heat absorption fin 67 in a development view, the fin 67 is provided with a plurality of holes "aa" to "an" and "na" to "nn" and is made of a material showing high heat conductivity.

FIG. 6 shows the net 69 filled in the spaces between the heat absorption fin 67 and the inner side surface of the liquid divider part 61. As shown in this drawing, the nets 69 which are scrubber type nets are filled in the spaces with a density that the nets 69 do not get removed from the spaces. The nets 69 are adapted for sucking (i.e., wicking) the remaining liquid phase refrigerant and evaporating the liquid phase refrigerant prior to refrigerant returning to the compressor 10.

The direction regulating unit 70 is placed about the inlet of the liquid receiver part 62 while the pair of outlets 100 and 101 are placed on the side wall opposed to the direction regulating unit 70.

The direction regulating unit 70 comprises a base 71 and a valve 73. The valve 73 of the unit 70 is rotatably mounted on the projection 72 extending from the front center of the base 71 by a hinge pin 74.

FIGS. 7*a* and 7*b* are a longitudinal sectional view and a cross sectional view of the base 71 of the direction regulating unit 70 respectively. As shown in these drawings, the base 71 of the direction regulating unit 70 is axially provided with a pair of refrigerant inlet holes. One of the refrigerant inlet holes is adapted for inlet of the refrigerant from the internal heat exchanger 50 during the heating operation while the other refrigerant inlet hole is adapted for inlet of the refrigerant from the external heat exchanger 30 during the cooling operation.

The projection 72 axially extends from the center of the base 71 and is provided with a pin hole 74*a*. When pivotally mounting the valve 73 to the projection 71, the hinge pin 74 is inserted in the pin hole 74*a* of the projection 72.

FIGS. 8*a* and 8*b* are a front view and a side view of the valve 73 of the direction regulating unit 70 respectively. As shown in these drawings, the valve 73 is a longitudinal plate provided with a pin hole 74*b* on its center.

When pivotally mounting the valve 73 to the projection 71, the hinge pin 74 which is inserted in the pin hole 74*a* of the projection 72 is also inserted in the pin hole 74*b* of the valve 73.

COOLING OPERATION

In the cooling operation of the above heating and cooling air conditioner, the refrigerant flows in order of the compressor 10, the direction selecting valve 20, the external heat exchanger 30, the liquid receiver part 62 of the combined liquid receiver and divider 60, the cooling pressure reducing unit 41, the internal heat exchanger 50, the direction selecting valve 20, the liquid divider part 61 of the combined liquid receiver and divider 60, the main liquid receiver 80 and the compressor 10. That is, the high temperature and high pressure refrigerant, after being compressed by the compressor 10, is introduced into the external heat exchanger 30 through the direction selecting valve 20. In the external heat exchanger 30, the high temperature and high pressure refrigerant is cooled and condensed, thus to be reduced from its vapor phase to its liquid phase.

The refrigerant, after being condensed by the external heat exchanger 30, can not be introduced into the heating pressure reducing unit 40 of high resistance but flows in the cooling-side conduit P2.

The refrigerant flowing in the cooling-side conduit P2 in turn is introduced into the liquid receiver part 62 of the combined liquid receiver and divider 60 through the direction regulating unit 70.

That is, when the refrigerant flows in the cooling-side conduit P2, the valve 73 of the refrigerant flow direction regulating unit 70 is turned about the pin 74 so as to allow the refrigerant flowing in the cooling-side conduit P2 to be introduced into the liquid receiver part 62. At this time, the valve 73 blocks the heating-side conduit P1.

The remaining liquid phase refrigerant introduced into the liquid receiver part 62 is reduced in both temperature and pressure while passing through the cooling pressure reducing unit 41, thus to become low temperature and low pressure refrigerant.

The low temperature and low pressure refrigerant in turn is introduced into the internal heat exchanger 50 where the refrigerant exchanges heat with the outside air and evaporates. Hence, desired cooling effect is achieved.

In the above procedure, the low temperature and low pressure refrigerant, after passing through the pressure reducing unit 41, can not be introduced into the liquid receiver part 62 since the heating-side conduit P1 is blocked by the direction regulating unit 70 as described above.

The gas refrigerant, after evaporating in the internal heat exchanger 50, in turn is introduced into the direction selecting valve 20 through the conduit P and, thereafter, introduced into the liquid divider part 61 through the refrigerant inlet conduit 64.

At this time, the remaining liquid phase refrigerant, which did not evaporate in the internal heat exchanger 50 because of low outside temperature about the outlet of the exchanger 50, is introduced into the direction selecting valve 20 along with the gas phase refrigerant through the conduit P and, thereafter, introduced into the liquid divider part 61 through the refrigerant inlet conduit 64.

From the liquid divider part 61, the gas phase refrigerant is directly discharged to the compressor 10 through the refrigerant outlet conduit 63. However, the liquid phase refrigerant exchanges heat with the heat absorption fin 67 and evaporates. The gas refrigerant, after evaporating as a result of heat exchanging with the fin 67, in turn is discharged to the compressor 10 through the refrigerant outlet conduit 63.

Here, the temperature of the liquid receiver part 62 is maintained at about 40° C. because of the refrigerant in the part 62 while the temperature of the liquid divider part 61 is maintained at about 10° C. Due to the temperature difference between the two parts 61 and 62, the heat of the liquid receiver part 62 is transferred to the heat absorption fin 67 through the casing of the liquid divider part 61 and in turn transferred to the nets 69, thus to completely evaporate the remaining liquid phase refrigerant.

Meanwhile, the compressor oil introduced into the liquid divider part 61 is discharged via the oil return holes 65*a* to 65*c* and in turn introduced into the compressor 10 by way of the main liquid receiver 80. In this regard, desired smooth operation of the compressor 10 is expected.

HEATING OPERATION

In the heating operation of the above heating and cooling air conditioner, the refrigerant flows in the following order: the compressor 10, the direction selecting valve 20, the internal heat exchanger 50, the liquid receiver part 62 of the combined liquid receiver and divider 60, the pressure reducing unit 40, the external heat exchanger 30, the direction selecting valve 20, the liquid divider part 61 of the combined liquid receiver and divider 60, the main liquid receiver 80 and the compressor 10. That is, the high temperature and high pressure refrigerant, after being compressed by the compressor 10, is introduced into the internal heat exchanger 50 through both the direction selecting valve 20 and the conduit P. In the internal heat exchanger 50, the high temperature and high pressure refrigerant is cooled and condensed, thus to be reduced from its vapor phase to its liquid phase.

The refrigerant, after being condensed by the internal heat exchanger 50, can not be introduced into the cooling pressure reducing unit 41 of high resistance but flows in the heating-side conduit P1. The refrigerant flowing in the heating-side conduit P1 pushes the valve 73 of the direction regulating unit 70 and is introduced into the liquid receiver part 62.

That is, the refrigerant flowing in the heating-side conduit P1 is introduced into the liquid receiver part 62 of the combined liquid receiver and divider 60 through the direction regulating unit 70.

When the refrigerant flows in the heating-side conduit P1, the valve 73 of the direction regulating unit 70 is turned about the pin 74 so as to allow the refrigerant flowing in the heating-side conduit P1 to be introduced into the liquid receiver part 62. At this time, the valve 73 blocks the cooling-side conduit P2.

The refrigerant introduced into the liquid receiver part 62 is cooled by the heat absorption fin 67 inside the liquid divider part 61. Thereafter, both the temperature and the pressure of the refrigerant are lowered while the refrigerant passes through the heating pressure reducing unit 40. The refrigerant thus becomes low temperature and low pressure refrigerant.

The low temperature and low pressure refrigerant in turn is introduced into the external heat exchanger 30 where the refrigerant exchanges heat with the outside air and evaporates. Hence, desired heating effect is achieved.

The gas refrigerant, after evaporating in the external heat exchanger 30, in turn is introduced into the direction selecting valve 20 and, thereafter, introduced into the liquid divider part 61 through the refrigerant inlet conduit 64.

At this time, the remaining liquid phase refrigerant, which did not evaporate in the external heat exchanger 30, is introduced into the direction selecting valve 20 along with the gas phase refrigerant. Thereafter, the liquid phase refrigerant as well as the gas phase refrigerant is introduced into the liquid divider part 61 through the refrigerant inlet conduit 64.

From the liquid divider part 61, the gas phase refrigerant is directly discharged to the compressor 10 through the refrigerant outlet conduit 63. However, the liquid phase refrigerant is accumulated in the bottom of the liquid divider part 61 and exchanges heat with the heat absorption fin 67 and evaporates. The gas refrigerant, after evaporating as a result of heat exchanging with the fin 67, in turn is discharged to the compressor 10 through the refrigerant outlet conduit 63.

When the outside temperature in the heating operation of the air conditioner is a low temperature not higher than −5° C., a large amount of liquid phase refrigerant which did not evaporate in the external heat exchanger 30 is introduced into the liquid divider part 61 through the refrigerant inlet conduit 64. In this regard, there may be generated a stratified division between compressor oil and the liquid phase refrigerant. However, the remaining liquid phase refrigerant completely evaporates due to both the heat absorption fin 67 and the net 69 provided in the liquid divider part 61 in accordance with the present invention, so that such possible stratified division between the compressor oil and the liquid phase refrigerant is prevented.

SECOND EMBODIMENT

Figure 9:
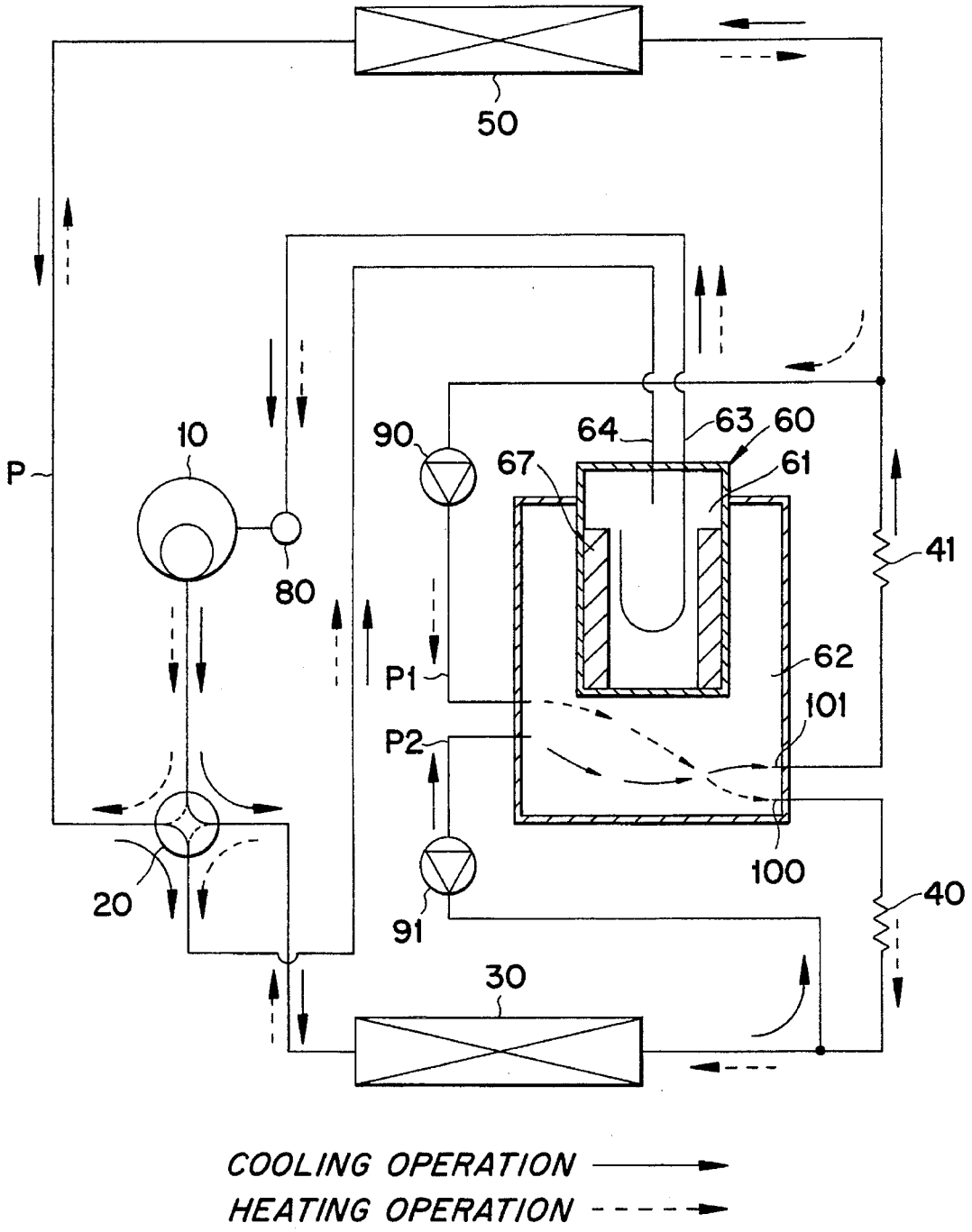
FIG. 9 is a diagrammatic view showing a construction of a heating and cooling air conditioner having a combined liquid receiver and divider in accordance with a second embodiment of the present invention.

FIG. 9 is a diagrammatic view showing a construction of a heating and cooling air conditioner having a combined liquid receiver and divider in accordance with a second embodiment of the present invention.

As shown in FIG. 9, the refrigerant flow in the air conditioner according to the second embodiment of this invention is controlled by a pair of check valves 90 and 91 instead of the direction regulating unit 70 of the primary embodiment of FIG. 2.

Differently from the primary embodiment of FIG. 2, the internal heat exchanger 50 is connected to the inlet of the liquid receiver part 62 of the combined liquid receiver and divider 60 by way of the first check valve 90. On the other hand, the external heat exchanger 30 is connected to the inlet of the liquid receiver part 62 of the combined liquid receiver and divider 60 by way of the second check valve 91.

With the above construction, the first check valve 90 opens the heating-side conduit P1 during the heating operation of the air conditioner so that the refrigerant, after being condensed by the internal heat exchanger 50, is introduced into the liquid receiver part 62 through the first check valve 90. In the heating operation of the air conditioner, the second check valve 91 closes the cooling-side conduit P2. Meanwhile, the second check valve 91 opens the cooling-side conduit P2 during the cooling operation of the air conditioner so that the refrigerant, after being condensed by the external heat exchanger 30, is introduced into the liquid receiver part 62 through the second check valve 91. In the cooling operation of the air conditioner, the first check valve 90 closes the heating-side conduit P1.

As described above, in connection with the first and second embodiments, the heating and cooling air conditioner in accordance with the present invention is provided with refrigerant flow direction regulating means installed in a combined liquid receiver and liquid divider, thus to control the refrigerant flow a simplified manner in accordance with the operation of the heating and cooling air conditioner. The air conditioner also includes both a heat absorption fin and refrigerant evaporating nets provided in a liquid divider part of the combined liquid receiver and liquid divider, thus to completely evaporate the remaining liquid phase refrigerant, and improve the operational efficiency of the air conditioner and to prevent possible stratified division between the compressor oil and the liquid phase refrigerant. With the effect of prevention of possible stratified division between the compressor oil and the liquid phase refrigerant, the air conditioner achieves smooth returning of the compressor oil to the compressor, thus to protect the compressor.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a heating and cooling air conditioner comprising a refrigeration cycle including indoor and outdoor heat exchangers; said indoor and outdoor heat exchangers discharging respective flows of refrigerant during operation of the cycle, a first of said flows containing a mixture of gaseous and residual liquid phases of the refrigerant; and an evaporator for evaporating the residual liquid phase of said first flow by transferring heat from a second of said flows; said evaporator including a divider chamber for receiving said first flow and separating said gaseous phase from said residual liquid phase, and a receiver chamber for receiving said second flow and conducting said second flow in heat exchange relationship with said divider chamber to transfer heat to said residual liquid phase; the improvement wherein:

said second flow is discharged from said indoor heat exchanger during a heating operation and from said outdoor heat exchanger during a cooling operation and said evaporator further comprising:

a first conduit for connecting said receiver chamber with said indoor heat exchanger to conduct said second flow to said receiver chamber during a heating cycle, a second conduit for connecting said receiver chamber with said outdoor heat exchanger to conduct said second flow to said receiver chamber during a cooling cycle, and valving means for opening said first conduit and closing said second conduit during the heating cycle, and for opening said second conduit and closing said first inlet during the cooling cycle.

2. The air conditioner according to claim 1, wherein said valving means is arranged to be actuated by a force generated by said second flow.

3. The air conditioner according to claim 2, wherein said receiver chamber includes a first inlet connected to said first conduit, and a second inlet connected to said second conduit, said valving means comprising a valve element mounted for free pivoting movement about an axis situated between said first and second inlets for being rotated in response to the entry of said second flow from either of said inlets for opening such inlet while closing the other inlet.

4. The air conditioner according to claim 1, wherein said valving means comprises separate valves connected to respective ones of said first and second conduits.

5. The air conditioner according to claim 4 wherein said valves comprise one-way check valves.

6. The air conditioner according to claim 1, wherein said improvement further comprises first and second outlets in said receiver chamber for selectively discharging said second flow; said first inlet being connected to said indoor heat exchanger by said first conduit; a third conduit interconnecting said first outlet with said first conduit at a location intermediate said indoor heat exchanger and said first inlet; a pressure reducing member disposed in said third conduit; said second inlet being connected to said outdoor heat exchanger by said second conduit; a fourth conduit interconnecting said second outlet with said second conduit at a location intermediate said outdoor heat exchanger; a pressure reducing member disposed in said fourth conduit.

7. An air conditioner according to claim 1 further including a compressor for supplying compressed refrigerant selectively to said indoor and outdoor heat exchangers, a fifth conduit connecting said divider chamber with an inlet of said compressor for conducting gaseous phase refrigerant thereto.

8. The air conditioner according to claim 1, wherein a lower end of said divider chamber is located within said receiver chamber and is positioned below an upper end of said receiver chamber to facilitate an exchange of heat between said second flow and residual liquid phase disposed in said lower end of said receiver chamber.

9. The air conditioner according to claim 8, wherein said divider chamber comprises heat transfer fins disposed at a lower end thereof.

10. The air conditioner according to claim 1, wherein said evaporator includes heat transfer fins disposed in said divider chamber at a lower end thereof and immersed in the residual liquid phase.

11. The air conditioner according to claim 10, wherein recesses are formed between said fins and an inner surface of said divider chamber, and a mesh structure disposed in said recesses for wicking the residual liquid phase.

12. The air conditioner according to claim 11, wherein the fins are arranged in an annular star shape, with outer edges of the star contacting said inner surface.

13. In a heating and cooling air conditioner comprising a refrigeration cycle including indoor and outdoor heat exchangers; each of said indoor and outdoor heat exchangers discharging respective flows of refrigerant during operation of the cycle, a first of said flows containing a mixture of gaseous and residual liquid phases of the refrigerant; and an evaporator for evaporating the residual liquid phase of said first flow by transferring heat from a second of said flows, the improvement wherein said evaporator comprises:

a liquid divider forming a divider chamber for receiving said first flow and separating a residual liquid phase from a gaseous phase thereof, said residual liquid phase collecting at a lower end of said divider chamber; a liquid receiver forming a receiving chamber for receiving said second flow;

a lower end of said divider chamber disposed within said receiving chamber and positioned below an upper end of said receiving chamber to facilitate the exchange of heat between said second flow and the residual liquid phase disposed in said lower end of said divider chamber for evaporating said residual liquid phase;

said evaporator further comprising heat transfer fins disposed in said divider chamber at a lower end thereof and immersed in the residual phase, said fins forming recesses with an inner surface of said divider chamber, and a mesh structure disposed in said recesses for wicking the residual liquid phase.

14. The air conditioner according to claim 13, wherein said refrigerant cycle further comprises a compressor having an inlet, and a conduit connecting said liquid divider chamber with said compressor inlet for conducting the gaseous phase of said first flow to said compressor inlet.

15. The air conditioner according to claim 13, wherein said liquid divider comprises heat transfer fins disposed at a lower end thereof.

16. The air conditioner according to claim 13, wherein the fins are arranged in an annular star shape, with outer edges of the star contacting said inner surface.

* * * * *